United States Patent [19]

Theurer

[11] 4,074,631

[45] Feb. 21, 1978

[54] BALLAST TAMPING IMPLEMENT ON A MOBILE TRACK TAMPER

[75] Inventor: Josef Theurer, Vienna, Austria

[73] Assignee: Franz Plasser Bahnbaumaschinen-Industriegesellschaft m.b.H., Vienna, Austria

[21] Appl. No.: 695,732

[22] Filed: June 14, 1976

[30] Foreign Application Priority Data

Feb. 20, 1976 Austria ..... 1239/76

[51] Int. Cl.[2] ..... E01B 27/16

[52] U.S. Cl. ..... 104/12

[58] Field of Search ..... 104/7 R, 7 B, 10, 12

[56] References Cited

U.S. PATENT DOCUMENTS

| | | | |
|---|---|---|---|
| 2,956,513 | 10/1960 | Philbrick | 104/12 |
| 3,669,025 | 6/1972 | Plasser et al. | 104/12 |
| 3,729,055 | 4/1973 | Burridge | 104/10 X |
| 3,799,059 | 3/1974 | Sieke et al. | 104/12 |

*Primary Examiner*—Robert J. Spar
*Assistant Examiner*—Randolph A. Reese
*Attorney, Agent, or Firm*—Kurt Kelman

[57] ABSTRACT

A ballast tamping implement capable of tamping ballast under track ties is constituted by a rigid unit which consists of a tamping tool holder and tamping tools mounted thereon for immersion in the ballast to the left and to the right of a track rail. The tamping tool holder has an arm mounted on the tamper for pivoting in a vertical plane passing through the track rail and two arms extending transversely of the track from the vertically extending arm to the left and to the right of the vertical plane whereby the tamping tool holder is centered with respect to the rail. The tamping tools are symmetrically mounted on the transversely extending holder arms.

5 Claims, 3 Drawing Figures

BALLAST TAMPING IMPLEMENT ON A MOBILE TRACK TAMPER

The present invention relates to an improved ballast tamping implement mounted on a mobile track tamper arranged for mobility on a track consisting of a multiplicity of ties and two rails fastened to the ties. The tamping implement is capable of tamping ballast under respective ones of the ties and is particularly useful in tamping heads in which pairs of vibratory tamping tools are mounted on a vertically movable carrier for reciprocating movement to tamp ballast underneath a tie positioned between the pairs of tools as the same are moved towards each other.

A great number of ballast tamping implements of this general type are known for use in automatic track tamping machines. In most of these known implements, the tamping tools are mounted symmetrically to the left and to the right of a rail on a vertically adjustable carrier. Usually, a single tamping tool or a pair of cooperating tools is arranged at each side of the rail. In U.S. Pat. No. 3,000,328, dated Sept. 19, 1961, a fork-shaped tamping tool implement with two tamping tools, or a pair of such implements, is mounted at each side of the rail, each such implement being connected to a vibratory and reciprocating drive for operation of the implements. The tamping head of the tamper disclosed in this patent comprises a tamping tool carrier vertically adjustably mounted for movement in a vertical plane passing through a track rail and a tamping tool pair on each side of the carrier, with respective drives for each pair of tools. These implements are comprised of tamping tool holders constituted by pivotal arms and the tamping tools are replaceably mounted in the lower ends of the pivotal holder arms. Thus, a pair of tamping tool implements with a total of four tamping tools is mounted on the tamping head at each side of the track rail. These tamping tool implements are useful for mounting on tamping heads either left or right of the rail.

It is the primary object of this invention to provide a tamping tool implement for mounting on a mobile track tamper, which makes the structure of the tamping head simpler, more robust and more economical. This object is accomplished according to the invention unexpectedly in a very simple structure.

In accordance with the present invention, the ballast tamping implement is a rigid, substantially fork-shaped unit consisting essentially of a tamping tool holder having an arm mounted on the tamper for pivoting in a vertical plane passing through a respective one of the rails and two arms extending transversely of the track from the vertical extending arm to the left and to the right of the vertical plane whereby the tamping tool holder is centered with respect to the one rail, and at least one ballast tamping tool mounted on each transversely extending holder arm and extending vertically downwardly from the holder arms for immersion in the ballast to the left and to the right of the one rail.

Figure 1:
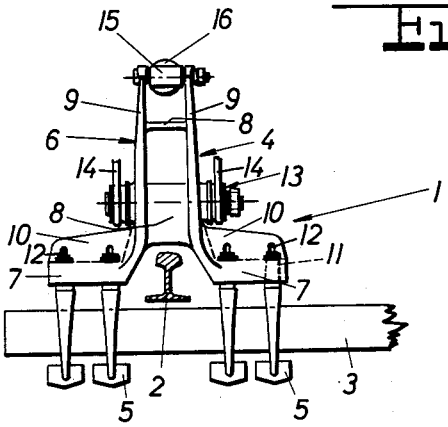
Figure 2:
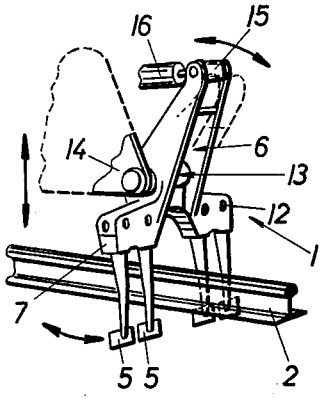
Figure 3:
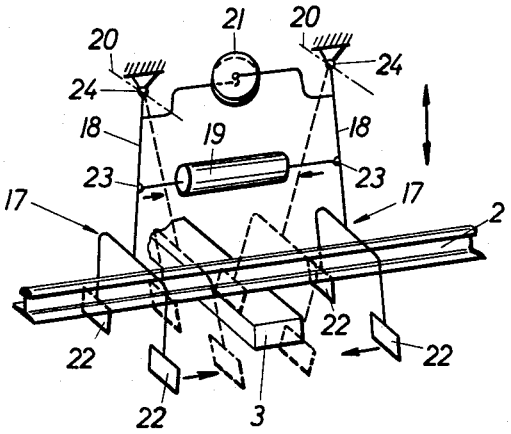

The above and other objects, advantages and features of this invention will become more apparent from the following detailed description of now preferred embodiments thereof, taken in conjunction with the accompanying schematic drawing wherein FIG. 1 is an end view of a specific embodiment of the ballast tamping implement;

FIG. 2 is a perspective view of the implement of FIG. 1, indicating its operation; and FIG. 3 is a diagrammatic view of another embodiment of the ballast tamping element arranged in a tamping head and illustrating the tamping of a tie.

A mobile track tamper with a tamping head incorporating the tamping tool implement of the present invention has been described and claimed in simultaneously filed U.S. patent application Ser. No. 695,733, entitled "Mobile Track Tamper", of the same inventor.

Referring now to the drawing and first to FIGS. 1 and 2, the track on which a mobile tamper (not shown) is arranged for mobility consists of a multiplicity of ties 3 and two rails 2 (only one being visible in the drawing) fastened to the ties. As will be obvious to those skilled in the art and is shown in FIG. 3, the tamping implement 1 is capable of tamping ballast under ties 3.

Implement 1 is constituted by a rigid unit which is substantially fork-shaped and arranged astride rail 2. It consists essentially of tamping tool holder 4 and tamping tools 5 detachably mounted on the holder. The illustrated tamping tool holder is substantially -shaped and has an arm 6 mounted on the tamper for pivoting in a vertical plane. The illustrated arm 6 consists of two webs, and it would be possible to space these webs transversely so that the holder becomes substantially H-shaped. Whatever the holder shape, arm 6 has a longitudinal plane of symmetry, and the pivoting plane is vertical to the track and passes through rail 2, the longitudinal plane of symmetry of tamping tool holder arm 6 extending in the vertical plane. Two arms 7, 7 extending transversely of the track from vertically extending arm 6 to the left and to the right of the vertical plane whereby tamping tool holder 4 is centered with respect to rail 2. Transversely extending holder arms 7, 7 are arranged mirror-symmetrically at the lower ends of vertically extending holder arm 6 and, as shown, arm 6 consists essentially of two longitudinal web members 9, 9 and bracing element 8 interconnecting the web members. Reinforcing webs 10 extend between holder arm 6 and holder arms 7, 7. This illustrated construction of holder 4 is particularly strong and resistant to very heavy loads and pressures, thus providing a very efficient tamping implement, particularly where two tamping tools are mounted on each transverse holder arm.

Tamping tools 5 are mounted on each transverse arm 7 and extend vertically downwardly from the holder arms for immersion in the ballast to the left and right of rail 2, two tamping tools being arranged on each arm in the illustrated embodiment. The tamping tools are detachably mounted on holder arms 7, 7 for ready replacement, for which purpose these arms have two conical bores 11 for receiving correspondingly shaped mounting portions of tamping tools 5 and reinforcing webs 10, 10 have holes 12 vertically aligned with bores 11 for receiving wedges detachably holding the tamping tools in holder 4. This arrangement is designed not only for the ready replacement of worn tamping tools, which are readily accessible on the freely projecting transverse holder arms 7, 7 but also provides considerable rigidity provided by the bracing and reinforcing elements. The reinforcing webs 10 constitute a continuing connection between web members 9 of arm 6 and transverse arms 7 to provide a true structural and force-transmitting unit.

The tamping tool implement described hereinabove is particularly useful in a vertically adjustable tamping head which has a carrier for the tamping tools. As shown in FIG. 2, tamping tool implement 1 is mounted on tamping tool carrier 14 of a tamping head, which has been indicated only schematically, by means of pivot 13 intermediate the ends of the implement for pivotally mounting the implement on the tamper. Bearing 15 at the upper end of vertically extending holder arm 6 links the implement to drive 16 for pivoting the holder arm in a vertical plane about pivot 13. The illustrated drive is a hydraulic motor drive as commonly used for the reciprocation of tamping tools for tamping ballast under ties.

The illustrated rigid tamping tool implement unit is particularly useful in the well known type of tamping head wherein pairs of tamping tools are mounted on a vertically movable carrier for immersion of the tools in the ballast, with a tie extending between the tamping tools of the pair and the tools connected to drives for vibrating the tools and moving the tools together towards the interposed tie to tamp ballast under the tie while being vibrated. Such a tamping head is mounted in vertical alignment with each track rail so that the ballast at the intersections between tie and rails is tamped whereby the track is supported on firmly packed ballast.

The pivotal mounting of the tamping tool implement shown in FIG. 2, which is known per se, has the particular advantage of very effectively transmitting vibrations of substantially constant amplitude to the implement from a vibratory drive (not shown). Furthermore, the arrangement of bearings 13 and 15 makes it possible to give the pivotal holder 4 a very advantageous configuration since the holder is symmetrical with respect to the bearings and thus very favorably absorbs all loads during the tamping operation while very efficiently transmitting the vibratory and reciprocatory forces to the implement.

The outstanding characteristic of the tamping tool implement of the present invention is its construction as a rigid unit mounted astride a track rail, the pivotal vertical arm and the transverse arms of the tamping tool holder as well as the tamping tools fixed on the transverse holder arms being in rigid connection. This simple construction produces a transmission of forces substantially without play from the drive means for the implement to the tamping tool jaws which tamp the ballast in a continuous flow of force, thus increasing the efficiency of tamping with the same power input to an unexpected degree. Furthermore, it greatly improves the space economy in tamping heads because two or four tamping tools mounted symmetrically with respect to the rail on the implement holder require only a single pivotal arm for transmission of the vibratory and reciprocatory movement to the tools. This, in turn, reduces the number of drives and, correspondingly, of transmission parts. The symmetrical arrangement astride the rail produces a uniform load on the entire implement. In summary, the tamping tool implement is simpler and more economical to build and to maintain, it is more accessible for repairs and it is much more efficient in operation than tamping tool units heretofore used on mobile track tampers.

In the tamping tool head schematically shown in FIG. 3, tamping tool implements 17 are basically of the same construction as tamping tool implement 1 of FIGS. 1 and 2, the illustrated pair of implements consisting essentially of holder arm 18 pivotal in a vertical plane passing through rail 2, two transverse holder arms extending from the lower end of holder arm 18 and a single tamping tool 22 mounted on each transverse arm to the left and to the right of rail 2 (instead of two tamping tools, as in the embodiment of FIGS. 1 and 2).

In this embodiment, holder arms 18 of tamping tool implements 17 are linked to hydraulic reciprocating drive 19 by bearing 23 intermediate the ends of the implements for pivoting vertical holder arms 18, 18 about transverse axis 20 in the vertical plane while pivot 24 at the upper end of the vertical holder arms links these arms to a vertically movable carrier for pivotally mounting the implements on the tamper. In a manner well known per se, eccenter shaft drive 21 is mounted between the pair of tamping tool implements to vibrate the implements.

The pivoting arrangement shown in FIG. 3 can be used effectively not only for hydraulic drives but also for machines in which reciprocation of the tamping tools is effected by a spindle-and-nut drive instead of a hydraulic motor. The tensile and impact forces between reciprocatory drive and tamping tools is fully absorbed by the pivotal tamping tool holder arm, thus relieving stresses on the tamping tool carrier and making it unnecessary to reinforce the carrier.

It will be understood by those skilled in the art that the invention is not limited to the illustrated embodiments hereinabove described. Various possibilities are available in connection with the configuration and structure of the rigid tamping tool implement unit. The tamping tool holder may be an integral cast iron shape or may be produced by welding parts together, for example. Furthermore, the implement may be used not only in the illustrated type of tamping head wherein a pair of tamping tools is mounted astride a tie for tamping ballast under the tie by a pincer movement of the tools but also in known arrangements wherein two tamping tool implements are immersed in the same crib and moved apart towards the adjacent ties wherebetween the implements are immersed. The metes and bounds of the present invention are defined by the appended claims.

What is claimed is:

1. A ballast tamping implement mounted on a mobile track tamper arranged for mobility on a track consisting of a multiplicity of ties and two rails fastened to the ties, the tamping implement being capable of tamping ballast under respective ones of the ties and constituted by a rigid unit consisting essentially of 1. a tamping tool holder having
   a. an arm having a longitudinal plane of symmetry and mounted on the tamper for pivoting in a plane vertical to the track and passing through a respective one of the rails, the longitudinal plane of symmetry of the tamping tool holder arm extending on the vertical plane, and
   b. two arms rigidly connected to, and extending transversely of the track from, the vertically extending arm to the left and to the right of the vertical plane whereby the tamping tool holder is centered with respect to the one rail, and
2. at least one stationary ballast tamping tool mounted on each of the transversely extending holder arms and extending vertically downwardly from the holder arms for immersion in the ballast to the left and to the right of the one rail.

2. The ballast tamping implement of claim 1, wherein the vertically extending holder arm consists essentially of two longitudinal members and a bracing element interconnecting the longitudinal members, the transversely extending holder arms being arranged mirror-symmetrically at the lower ends of the vertically extending holder arm, and further comprising reinforcing webs between the vertically extending holder arm and the traversely extending holder arms.

3. The ballast tamping implement of claim 2, wherein each of the transversely extending holder arms has two conical bores for receiving correspondingly shaped mounting portions of respective ones of the tamping tools for replaceable mounting of four of said tools in the holder, and the reinforcing webs have holes vertically aligned with the bores for receiving wedges detachably holding the tamping tools in the holder.

4. The ballast tamping implement of claim 1, further comprising a pivot intermediate the ends of the implement for pivotally mounting the implement on the tamper, and a bearing at the upper end of the vertically extending holder arm for connecting the implement to a drive for pivoting the vertically extending holder arm in the vertical plane.

5. The ballast tamping inplement of claim 1, further comprising a bearing intermediate the ends of the implement for connecting the implement to a drive for pivoting the vertically extending holder arm in the vertical plane and a pivot at the upper end of the vertically extending holder arm for pivotally mounting the implement on the tamper.

* * * * *